US009162444B2

(12) United States Patent
Endo et al.

(10) Patent No.: US 9,162,444 B2
(45) Date of Patent: Oct. 20, 2015

(54) PRINTING APPARATUS

(71) Applicant: SEIKO EPSON CORPORATION, Tokyo (JP)

(72) Inventors: Tsunenobu Endo, Matsumoto (JP); Shogo Kurosawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/092,679

(22) Filed: Nov. 27, 2013

(65) Prior Publication Data

US 2014/0152734 A1 Jun. 5, 2014

(30) Foreign Application Priority Data

Nov. 30, 2012 (JP) ..... 2012-262117
Dec. 19, 2012 (JP) ..... 2012-276559

(51) Int. Cl.

| | |
|---|---|
| ***B41J 29/38*** | (2006.01) |
| ***B41J 2/045*** | (2006.01) |
| ***B41J 11/00*** | (2006.01) |
| *B41J 2/01* | (2006.01) |

(52) U.S. Cl.
CPC ..... *B41J 2/04556* (2013.01); *B41J 11/0095* (2013.01)

(58) Field of Classification Search
CPC ..... B41J 2/04556; B41J 11/20; B41J 11/42; B41J 25/308; B41J 29/38; B41J 29/393
USPC ..... 347/16, 19, 101, 104
See application file for complete search history.

(56) References Cited

U.S. PATENT DOCUMENTS

| | | | | |
|---|---|---|---|---|
| 6,905,187 | B2 * | 6/2005 | Arquilevich et al. | 347/19 |
| 7,396,101 | B2 | 7/2008 | Watarai | |
| 7,748,834 | B2 * | 7/2010 | Hamano | 347/86 |
| 8,042,904 | B2 * | 10/2011 | Niihara et al. | 347/19 |
| 2003/0197750 | A1 | 10/2003 | Iwatsuki et al. | |
| 2004/0075708 | A1 | 4/2004 | Arakawa | |
| 2004/0080553 | A1 * | 4/2004 | Kim | 347/8 |
| 2005/0024410 | A1 | 2/2005 | Subirada et al. | |
| 2005/0110822 | A1 * | 5/2005 | Hwang et al. | 347/19 |
| 2007/0047157 | A1 | 3/2007 | Miyahara et al. | |
| 2009/0303276 | A1 | 12/2009 | Van De Wynckel et al. | |

FOREIGN PATENT DOCUMENTS

| | | |
|---|---|---|
| JP | 05-262019 | 10/1993 |
| JP | 11-115166 | 1/1999 |
| JP | 2004-188954 | 7/2004 |
| JP | 2005-053228 | 3/2005 |
| JP | 2005-280037 | 10/2005 |
| JP | 2006-168138 | 6/2006 |
| JP | 2007-091467 | 4/2007 |
| JP | 2010-042678 | 2/2010 |

* cited by examiner

*Primary Examiner* — Jannelle M Lebron
*Assistant Examiner* — Jeremy Bishop
(74) *Attorney, Agent, or Firm* — Workman Nydegger

(57) ABSTRACT

A printing apparatus includes a position detection unit which includes an optical element, a light source and a light receiving element, radiates light from the light source toward the printing surface, causes diffused reflection light of reflection light which is reflected by the printing surface to be incident to the light receiving element through the optical element and outputs positional information relating to a position of the printing surface at which the light from the light source reflects, from the light receiving element, and a controller which causes movement of the carriage to stop when lifting up of the printing medium is detected on a basis of the positional information output from the light receiving element, in which a virtual plane which contains the optical element and the light receiving element is in a state of being inclined in relation to a normal line of the printing surface.

10 Claims, 10 Drawing Sheets

PRINTING APPARATUS

BACKGROUND

1. Technical Field

The present invention relates to a printing apparatus which forms an image on a printing surface of a printing medium which is transported in the sub-scanning direction by causing a carriage with a printing unit mounted thereon to move in the main scanning direction.

2. Related Art

An ink jet printing apparatus is a well-known representative example of such a printing apparatus. In the printing apparatus, a printing unit such as a print head discharges ink droplets toward a printing medium surface while moving in a transport direction of the printing medium, that is, the main scanning direction which orthogonally intersects the so-called sub-scanning direction, in a position of being distanced upward from the printing medium surface (the printing surface), and the printing medium is sequentially transported in the sub-scanning direction. In this manner, images, characters and the like are printed onto the printing medium.

In the printing apparatus, there is a case in which wrinkling occurs in the printing medium due to transport shifting during the transporting of the printing medium. In addition, there is a case in which so-called cockling occurs in which the printing medium forms waves due to stretching or the like caused by ink absorption of the printing medium or heating of the printing medium. When these phenomena occur, there is a case in which the printing medium lifts up partially and the print head rubs against or collides with the printing medium surface during a printing operation.

Therefore, in order to suppress such problems, an apparatus disclosed in JP-A-5-262019 (paragraph [0035]) is proposed, for example. The apparatus is provided with a sensor which detects a gap (an interval) between a printing medium and a print head, and when a detection result according to the sensor deviates from a stipulated amount, it is determined that lifting up of the printing medium has occurred and the movement of the carriage is stopped. Accordingly, in the apparatus, rubbing and collision of the print head in relation to the printing medium surface is suppressed.

Incidentally, in order to suppress the rubbing and the collision of the print head, it is important to detect the lifting up of the printing medium. Therefore, in the related art, in order to detect the gap between the printing medium and the print head, the technology disclosed in JP-A-2006-168138 (FIG. 12) is proposed, for example. The apparatus disclosed in JP-A-2006-168138 (FIG. 12) irradiates the printing medium with light, receives the regular reflection light from the printing medium surface using a line sensor, and calculates the distance from the print head to the printing medium, that is, the so-called printing medium distance, on the basis of the output from the line sensor.

However, since the printing medium distance is obtained using regular reflection light, there is a case in which the printing medium is inclined according to the surface state of the printing surface, in particular, whether or not the lifting up occurs in the printing medium, the angle of the regular reflection changes, and it is difficult to accurately calculate the printing medium distance. Therefore, when the invention disclosed in JP-A-2006-168138 (FIG. 12) is applied to the apparatus disclosed in JP-A-5-262019 (paragraph [0035]) as the unit which detects the lifting up of the printing medium, there is a possibility that the rubbing and the collision of the print head in relation to the printing medium surface (the printing surface) may not be avoided, or that even when the rubbing and the collision do not occur, the movement of the carriage will be stopped. Accordingly, there is a concern that the effect of suppression of the rubbing or the like is not sufficiently exhibited.

SUMMARY

An advantage of some aspects of the invention is that a printing apparatus is provided which can accurately detect the lifting up of the printing medium and can effectively suppress the rubbing and the collision of the printing unit in relation to the printing surface of the printing medium.

According to an aspect of the invention, there is provided a printing apparatus that forms an image on a printing surface of a printing medium which is transported in a sub-scanning direction by causing a carriage with a printing unit mounted thereon to move in a main scanning direction, that includes a position detection unit which includes an optical element configured by an aperture or a lens, a light source and a light receiving element, irradiates the printing surface with light from the light source, causes diffused reflection light of reflection light which is reflected by the printing surface to be incident to the light receiving element through the optical element and outputs positional information relating to a position of the printing surface at which the light from the light source reflects, from the light receiving element, and a controller which causes movement of the carriage to stop when lifting up of the printing medium is detected on a basis of the positional information output from the light receiving element, in which a virtual plane which contains the light source, the optical element and the light receiving element is in a state of being inclined in relation to a normal line of the printing surface.

In the printing apparatus configured in this manner, the diffused reflection light of the reflection light which is reflected by the printing surface is incident to the light receiving element through the optical element. Here, when the virtual plane which contains the light source the optical element and the light receiving element is disposed so as to be parallel with the normal line of the printing surface, the diffused reflection light decreases when the printing surface is subjected to printing and the printing concentration increases. However, since the regular reflection light does not decrease, when the regular reflection light and the diffused reflection light are incident to the light receiving element at the same time, the influence of the regular reflection light is greater. In addition, according to the surface state of the printing surface, there is a case in which the regular reflection light is incident to the light receiving element through the optical element. In contrast, in the present invention, since the virtual plane is inclined in relation to the normal line of the printing surface, even if lifting up occurs in the printing surface and the light from the light source is incident to the lifted up portion, the regular reflection light, which reflects regularly, always proceeds in a moving-away direction from the optical element and the light receiving element. Therefore, incidence of the regular reflection light to the light receiving element is prevented regardless of the presence or absence of lifting up in the printing surface, only diffused reflection light is incident to the light receiving element, and the distance to the printing surface can be accurately detected. Moreover, the detection resolution of the printing medium distance increases by the amount by which the virtual plane is inclined in relation to the normal line of the printing surface. For example, when the inclination angle is $\theta$, the resolution of the light receiving element is a value which is multiplied by $\cos\theta$, and the detection resolution improves in comparison to a case in which the virtual plane is disposed parallel to the normal line of the printing surface. Therefore, the printing medium distance can be obtained at a high resolution without receiving the influence of the printing state or the surface state of the printing surface, and the lifting up of the printing medium can be accurately detected. As a result, the rubbing and the collision of the printing unit in relation to the printing surface of the printing medium can be effectively suppressed.

Here, the virtual plane is in a state of being inclined in the sub-scanning direction in relation to the normal line of the printing surface.

In addition, the virtual plane is in a state of being inclined in the main scanning direction in relation to the normal line of the printing surface.

Furthermore, the position detection unit may be installed in the carriage such that the light from the light source reflects at a position distanced from the printing unit in the main scanning direction, and it is therefore possible to detect whether or not lifting up is occurring in the surface part which is positioned closer to the front in the main scanning direction within the printing surface than the carriage, that is, the surface part of the previous stage of the printing. In this manner, it is possible to start the movement stopping of the carriage before the arrival of the printing unit at the portion which is lifting up. In other words, the allowable time necessary to stop the carriage movement, that is, the stopping margin, is expanded. As a result, the rubbing or the collision of the print head can be more effectively suppressed.

Here, a configuration may also be adopted in which the position detection unit includes a housing which accommodates the optical element, the light source and the light receiving element, and a shielding member configured by a material which is non-transmissive in relation to regular reflection light of reflection light which is reflected by the printing surface, and in which the shielding member is provided to extend from the housing in a direction in which the regular reflection light proceeds, and blocks the regular reflection light. In this manner, the regular reflection light can be prevented from returning to the housing side by providing the shielding member, and the occurrence of stray light can be suppressed. Furthermore, the influence of the light from outside can also be suppressed by the shielding member. As a result, it is possible to more accurately detect the printing medium distance.

In addition, when a reflection prevention member is provided on the incidence surface of the shielding member to which the regular reflection light is incident, the reflection of the regular reflection light in the incidence surface is prevented by the reflection prevention member and the occurrence of stray light and the influence of external light can be further suppressed. Therefore, it is possible to more accurately detect the printing medium distance.

In addition, in order to accurately detect the lifting up of the printing medium and appropriately stop the movement of the carriage, for example, a configuration may also be adopted in which the controller is provided with a distance derivation unit which obtains a printing medium distance from the printing unit to the printing surface on a basis of positional information which is output from the light receiving element; a lifting up detection unit which detects lifting up of the printing medium on the basis of the printing medium distance obtained by the distance derivation unit, and a movement stopping unit which causes movement of the carriage to stop when the lifting up detection unit detects the lifting up of the printing medium.

A configuration such as the following may also be adopted for the detection of the lifting up of the printing medium. For example, a configuration may be adopted in which the lifting up detection unit detects the lifting up of the printing medium on the basis of whether or not the printing medium distance is shorter than a threshold value which is set in advance. Accordingly, the movement of the carriage is stopped at the point in time at which the printing unit approaches and reaches the printing medium, and the rubbing or the collision of the printing unit in relation to the printing surface of the printing medium is suppressed.

Furthermore, as another configuration, a configuration may be adopted in which the lifting up detection unit obtains the printing medium distance when the carriage is assumed to have moved only a distance which is set in advance, that is, an estimated distance, and the lifting up detection unit detects the lifting up of the printing medium on the basis of whether or not the estimated distance is shorter than a threshold value which is set in advance. By estimating the approach of the printing unit to the printing medium in this manner, a movement stopping operation of the carriage can be started before the printing unit approaches and reaches the distance indicated by the threshold value, and the suppression of the rubbing or the collision of the printing unit in relation to the printing surface of the printing medium can be rendered more reliable. Furthermore, when performing such estimation control, it is favorable to obtain the estimated distance at a high precision, and for example, it is possible to adopt a configuration in which a change in the printing medium distance which accompanies movement of the carriage is obtained, and the estimated distance is obtained on the basis of the change.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
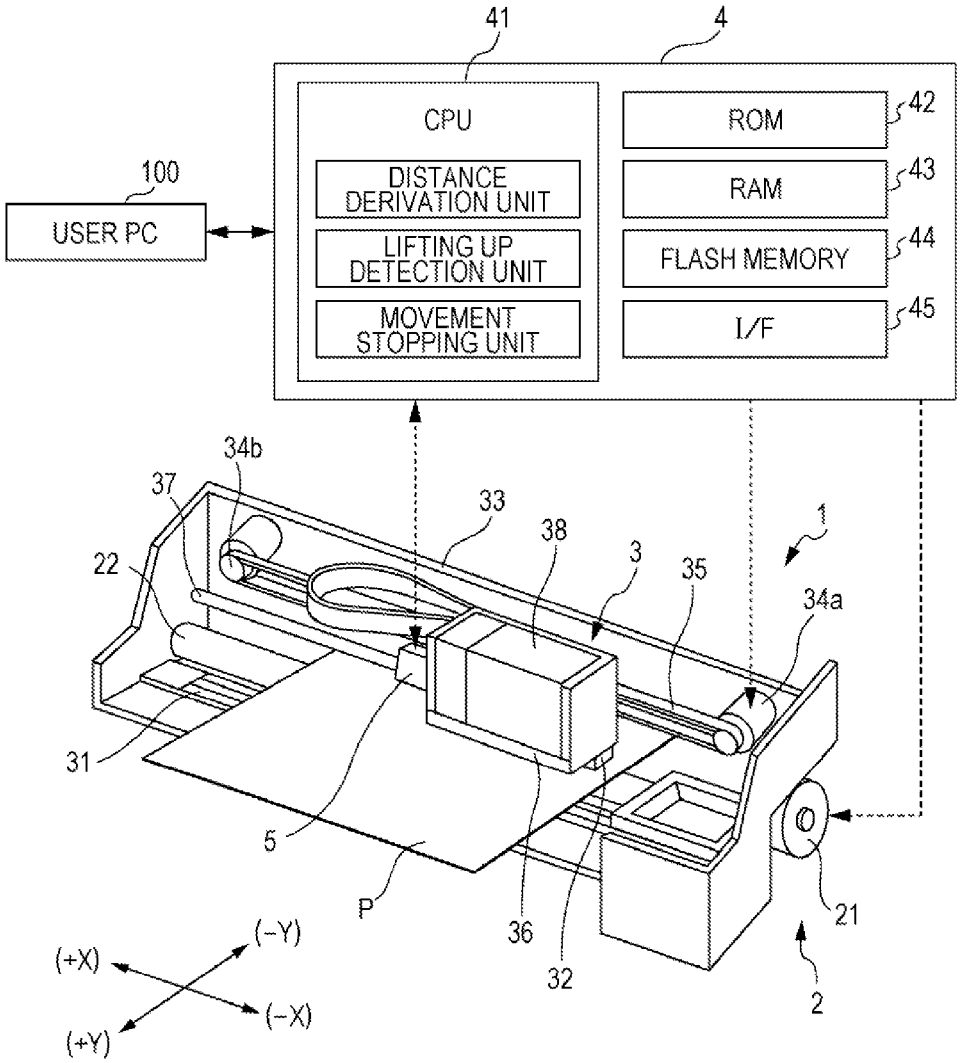
FIG. 1 is a view showing a first embodiment of a printing apparatus according to the invention.

FIG. 1 is a diagram schematically showing the configuration of an ink jet printer which is the first embodiment of the printing apparatus according to the invention. An ink jet printer 1 is an apparatus which prints images, characters and the like onto the surface of a printing medium P such as normal paper, coated paper and a film on the basis of printing data which is transmitted from a user personal computer (hereinafter referred to as a "user PC") 100 which is configured as a well-known ordinary computer. As shown in FIG. 1, the ink jet printer 1 is provided with a paper feed mechanism 2 which transports the printing medium P in a transport direction, that is, in a sub-scanning direction Y by driving a paper feed roller 22 using a printing medium feed motor 21. The ink jet printer 1 is also provided with a printer mechanism 3 which performs printing by discharging ink droplets from a print head 32 onto the surface of the printing medium P which is transported onto a platen 31 using the paper feed mechanism 2. The ink jet printer 1 is also provided with a controller 4 which controls the entire ink jet printer 1.

The printer mechanism 3 includes a carriage motor 34*a* which is disposed on one end (the right end of the diagram) of a mechanical frame 33 and a driven roller 34*b* which is disposed on the other end (the left end of the diagram) of the mechanical frame 33. Furthermore, a carriage belt 35 bridges the carriage motor 34*a* and the driven roller 34*b*. A portion of the carriage belt 35 is linked to a carriage 36. Therefore, when the carriage motor 34*a* operates on the basis of an operation command from the controller 4, the carriage 36 moves reciprocally in the main scanning direction (the left-right direction in the diagram) X along a carriage shaft 37. Furthermore, a linear encoder (omitted from the drawing), which outputs a pulse-shaped signal to the controller 4 together with the movement of the carriage 36, is disposed on the rear surface of the carriage 36. The controller 4 manages the position of the carriage 36, that is, the carriage position in the main scanning direction X on the basis of the signal from the linear encoder.

The print head 32, an ink cartridge 38 and a position detection unit 5 are mounted on the carriage 36 and move in the main scanning direction X integrally with the carriage 36. The ink cartridge 38 individually accommodates inks of each color of CMYK of cyan (C), magenta (M), yellow (Y) and black (K) in which, a coloring agent such as a dye or a pigment is contained in a solvent such as water. Furthermore, the print head 32 receives a supply of an ink from the ink cartridge 38 and discharges ink droplets. Furthermore, the position detection unit 5 is installed on the side surface of the (+X) direction side of the carriage 36 and outputs a signal relating to the distance (hereinafter referred to as the "printing medium distance") from the print head 32 to the printing medium P on the platen 31 to the controller 4. Description will be given of the configuration of the position detection unit 5 later.

As shown in FIG. 1, the controller 4 is configured as a microprocessor with a central processing unit (CPU) 41 as a key component. In addition to the CPU 41, the controller 4 is provided with read only memory (ROM) 42 which stores various types of process programs, random access memory (RAM) 43 which temporarily stores data, flash memory 44 which is capable of writing and erasing data, an interface (I/F) 45 which exchanges information with external apparatuses, and an input output port (not shown). A print buffer region is provided in the RAM 43, and printing data which is transmitted from the user PC 100 via the interface (I/F) 45 is stored in the print buffer region. Furthermore, every time that the CPU 41 outputs a drive signal to the printing medium feed motor 21 and sequentially transports the printing medium P in the sub-scanning direction Y, the CPU 41 outputs a drive signal to the carriage motor 34*a* and causes the carriage 36 to move reciprocally in the main scanning direction X. In addition, the CPU 41 provides a drive signal to the print head 32 corresponding to the transport of the printing medium P and the reciprocal movement of the carriage 36, and discharges ink droplets from the print head 32. Accordingly, images, characters and the like which correspond to the printing data are printed onto the surface of the printing medium P, that is, onto a printing surface PS (refer to FIG. 3).

While the printing onto the printing medium P is being performed, the CPU 41 exchanges various signals with the position detection unit 5, which is configured as described next, and derives the printing medium distance. Furthermore, when the CPU 41 detects the lifting up of the printing surface PS on the basis of the printing medium distance, the CPU 41 causes the carriage 36 to stop rapidly. Hereinafter, after describing the configuration of the position detection unit 5 with reference to FIGS. 2A, 2B and 3, detailed description will be given of the operations with reference to FIGS. 4 and 5.

Figure 2A:
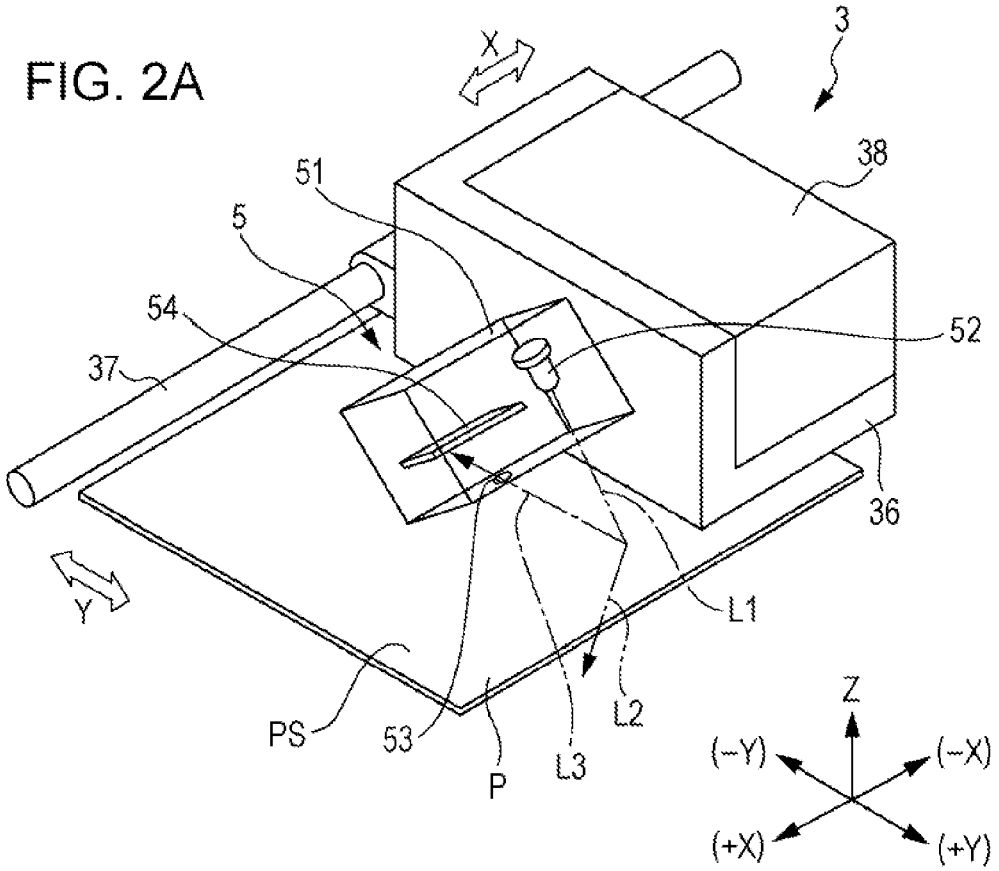
FIGS. 2A and 2B are views schematically showing the installation state of a position detection unit to a carriage.
Figure 2B:
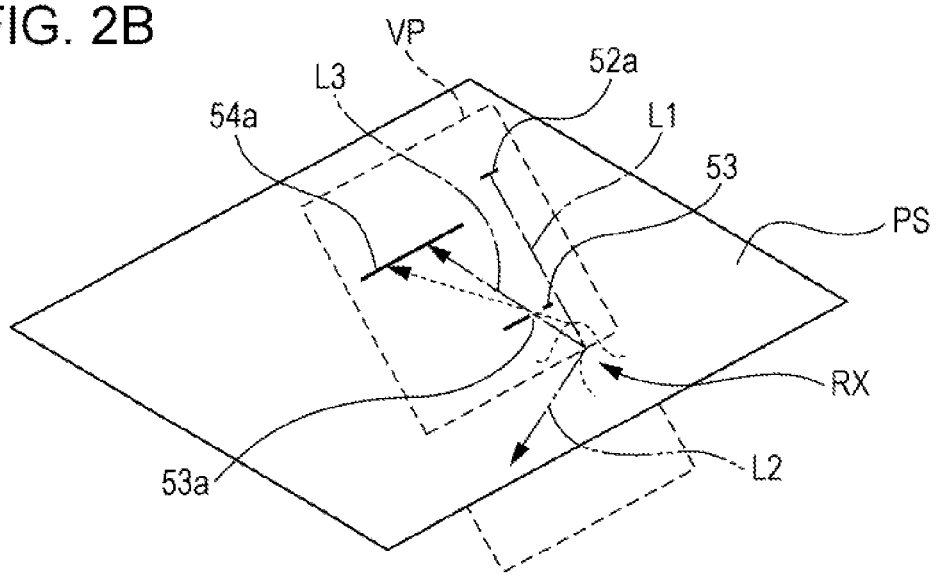
Figure 3:
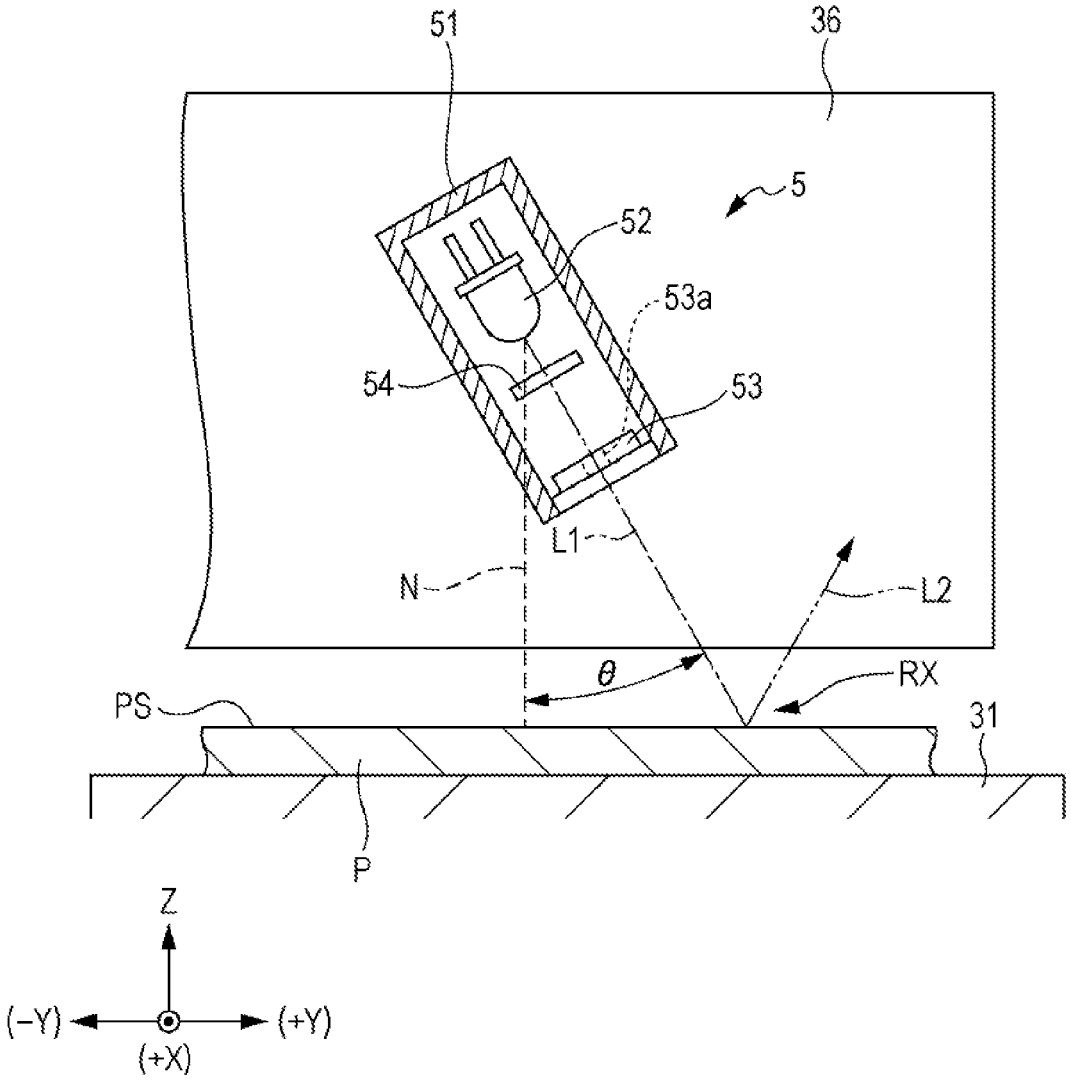
FIG. 3 is a diagram showing the internal structure of the position detection unit.

FIGS. 2A and 2B are views showing the configuration of the position detection unit and the installation state thereof to the carriage. FIG. 2A is a perspective view showing the installation structure, and FIG. 2B is a view showing the disposition relationships of the various parts which configure the position detection unit. In addition, FIG. 3 is a view showing the internal structure of the position detection unit. In the position detection unit 5, a light source 52, an aperture 53 and a light receiving element 54 are accommodated inside a housing 51. In addition, the position detection unit 5 detects the position of the surface of the printing medium P in the height direction Z which orthogonally intersects the main scanning direction X and the sub-scanning direction Y, that is, the printing surface PS, and outputs positional information which is related to the detected position. More specifically, as shown in FIG. 3, the housing 51 has a box structure with a vacancy formed therein for disposing the light source 52, the aperture 53 and the light receiving element 54. In addition, the bottom portion of the housing 51 is configured by a member, which is transparent in relation to a light beam L1 of the light source 52, such as a resin or a glass plate. Furthermore, the lower end portion of the housing 51 is inclined to the (+Y) direction by a predetermined inclination angle θ in relation to the normal line N of the printing surface PS so as to be positioned closer to the (+Y) direction side than the upper end portion. In addition, the housing 51 is installed on the (+X) side surface of the carriage 36 using a housing fixing portion (not shown) in a state in which the transparent member faces, of the printing surface PS, a measured region RX which is positioned closer to the (+Y) direction side than the vertical lower position of the light source 52. Furthermore, the normal line N indicates a normal line of the printing surface PS in a planar state in which the printing medium P is placed so that there is no wrinkling, lifting up or the like when printing.

As shown in FIG. 2A, the light source 52 and the light receiving element 54 are disposed to be separated from each other in the main scanning direction X in the internal vacancy of the housing 51, and of these, the light source 52 is fixed in a state in which a light emitting surface 52*a* faces the measured region RX at the (−X) direction side in relation to the light receiving element 54. Therefore, the light beam L1 generated by the light source 52 is emitted to be inclined to the (+Y) direction in relation to the normal line N of the printing surface PS by the angle θ in the same manner as the housing 51, and the measured region RX is irradiated with the light beam L1 via the transparent member (omitted from the drawing). Furthermore, the light beam L1 reflects at the measured region RX and, as shown by the two-dot chain lines in FIGS. 2A and 2B, regular reflection light L2 of the reflection light proceeds in a separating direction from the carriage 36 and housing 51. Meanwhile, a portion of the diffused reflection light passes through an opening portion 53*a* of the aperture 53 which is disposed as shown next and is incident to the light receiving element 54. Furthermore, in the embodiment, an infrared or red light beam L1 is used, and the beam diameter is set to from 2 mm to 10 mm. In addition, in order to avoid even a portion of the regular reflection light L2 entering the light receiving element 54 and the detection precision decreasing, the housing 51 is installed to be inclined as described above, and a position which is separated from a vertical lower position of the light source 52 by at least the beam diameter of the light beam L1 or more is used as the measured region RX. For example, it is preferable that the inclination angle θ be set to 15° or more. However, when the inclination angle θ exceeds 45°, the luminous energy of the diffused reflection light which is incident to the light receiving element 54 decreases greatly. Therefore, it is preferable that the inclination angle θ be set to 15° or more and 45° or less, and the inclination angle θ is set to 25° in the embodiment.

The light receiving element 54 is configured by a position sensitive detector (PSD) which extends in the up-down direction, a line sensor, a photodiode array or the like, and a light receiving surface 54*a* is disposed facing the light source 52. However, in the embodiment, corresponding to the fact that the light axis of the light beam L1 is inclined by the angle θ to the (+Y) direction in relation to the normal line N, as shown in FIGS. 2A and 2B, the long edge of the light receiving surface 54*a* is inclined to the (+Y) direction in relation to the normal line N of the printing surface PS by the angle θ in the same manner as the housing 51, and the light receiving surface 54*a* is inclined so as to be substantially perpendicular to the light axis of the light beam L1.

As shown in FIG. 2B, the aperture 53 is disposed on the upper surface of the transparent member such that the opening portion 53*a* is positioned on the virtual plane VP which contains the light emitting surface 52*a* of the light source 52 and the light receiving surface 54*a* of the light receiving element 54. The light source 52, the aperture 53 and the light receiving element 54 are fixed in relation to the housing 51. Therefore, for example, as shown by the dotted line in FIG. 2B, when the measured region RX lifts up, the angle of a diffused reflection light L3 which passes through the opening portion 53*a* of the aperture 53 and is incident to the light receiving element 54 differs from the angle before the lifting up. As a result, the position at which the diffused reflection light L3 is received by the light receiving surface 54*a* also changes. Specifically, when the lifting up does not occur, that is, when the measured region RX is positioned at a height position which is sufficiently separated from the print head 32, the light receiving element 54 receives the diffused reflection light L3 at the side (the −X direction side) which is close to the light source of the light receiving surface 54*a*. In contrast, when the lifting up occurs, the measured region RX approaches the print head 32 and the light receiving element 54 receives the diffused reflection light L3 at the side (the +X direction side) which is far from the light source of the light receiving surface 54*a*. In the embodiment, using the facts described above, the position at which the diffused reflection light L3 is received, that is, the position at which the received luminous energy is greatest is set as the height position of the measured region RX. Furthermore, the light receiving element 54 outputs a signal relating to the position as positional information indicating the height position of the measured region RX to the controller 4.

In the controller 4, the CPU 41 calculates the printing medium distance on the basis of the positional information according to the processing program which is stored in the ROM 42, and the printing medium distance is used as the measured value (the measurement of the printing medium distance). In addition, the CPU 41 detects the presence or absence of the lifting up of the printing medium P on the basis of the measured value and stops the movement of the carriage 36 in the main scanning direction X when the lifting up is detected. In this manner, in the embodiment, the CPU 41 functions as the "distance derivation unit", the "lifting up detection unit" and the "movement stopping unit" of the invention and controls each portion of the apparatus to execute the operations shown in FIG. 4.

Figure 4:
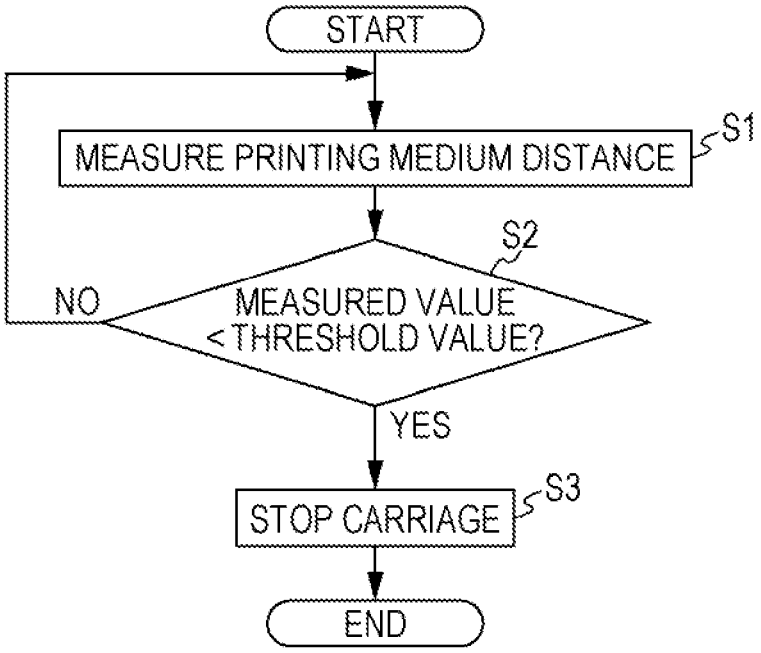
FIG. 4 is a flow chart showing the operations of the printing apparatus shown in FIG. 1.
Figure 5:
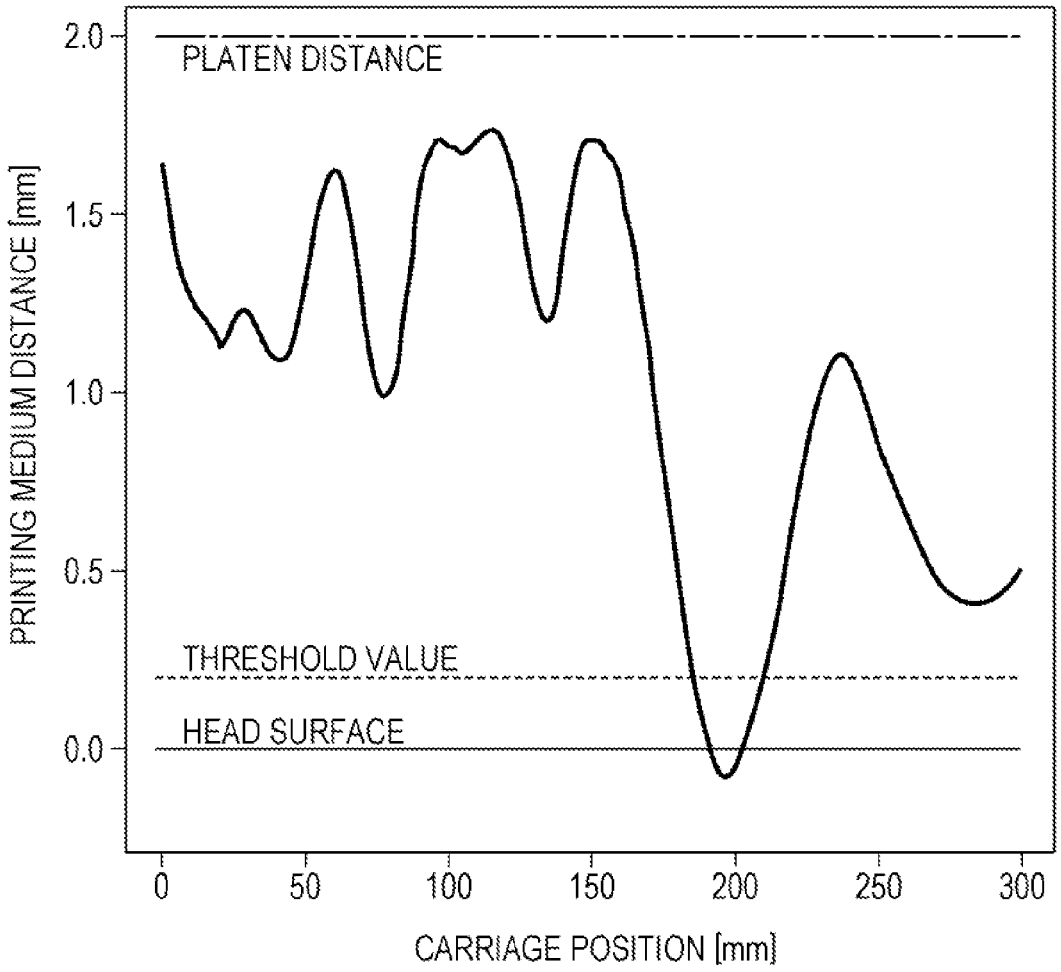
FIG. 5 is a graph showing an example of a change in the printing medium distance in relation to the carriage position, and the operation of the printing apparatus.

FIG. 4 is a flow chart showing the operations of the printing apparatus shown in FIG. 1. In the embodiment, during the printing operation, the measurement process of the printing medium distance described above is repeatedly executed (step S1). According to the repetition of the measurement process, the change of the printing medium distance in relation to the carriage position as shown in FIG. 5, for example, may be obtained. In FIG. 4, the lifting up of the printing medium P occurs near the carriage position 200 mm, the printing medium distance decreases greatly and the printing surface PS (refer to FIG. 3) of the printing medium P collides with the print head 32. Therefore, in the embodiment, a value of approximately 10% to 30% of the interval between the platen 31 and the print head 32 is set as the "threshold value", and the measurement of the printing medium distance is continually performed while causing the carriage 36 to move in the main scanning direction X as long as the measured value is the threshold value or more ("NO" in step S2). Meanwhile, when the measured value is less than the threshold value ("YES" in step S2), the movement of the carriage 36 is forcibly stopped according to a movement stopping command from the CPU 41 (step S3). Accordingly, it is possible to effectively suppress the rubbing and the collision of the print head 32 in relation to the printing medium P.

As described above, according to the embodiment, the light source 52, the aperture 53 and the light receiving element 54 are disposed so that the virtual plane VP which contains the light source 52, the aperture 53 and the light receiving element 54 is inclined to the (+Y) direction in relation to the normal line N of the printing surface PS. Therefore, the following effects can be obtained. In other words, the regular reflection light L2, which is regularly reflected at the printing surface PS, proceeds in a moving-away direction from the aperture 53 and the light receiving element 54 as shown by the two-dot line in FIGS. 2A and 2B. Therefore, the incidence of the regular reflection light L2 to the light receiving element 54 can be reliably prevented regardless of the surface state of the printing surface PS and only the diffused reflection light L3 is incident to the light receiving element 54. Moreover, the detection resolution of the printing medium distance increases by the amount by which the virtual plane is inclined in relation to the normal line N of the printing surface PS. In other words, the resolution of the light receiving element 54 is a value obtained by multiplying cos θ by the resolution of a case in which the virtual plane VP is disposed parallel to the normal line N, and the detection resolution can be improved in comparison to a case in which the virtual plane VP is disposed parallel to the normal line of the printing surface PS.

In this manner, the printing medium distance can be obtained at a high resolution without receiving the influence of the printing state or the surface state of the printing surface PS, and the lifting up of the printing medium P can be accurately detected. As a result, the rubbing and the collision of the print head 32 in relation to the printing surface PS of the printing medium P can be effectively suppressed.

In this manner in the embodiment, the print head 32 is equivalent to an example of the "printing unit" of the invention. In addition, the position of the measured region RX in the direction Z, that is, the height position is equivalent to "the position of the printing surface at which the light from the light source reflects". Furthermore, the aperture 53 is equivalent to an example of the "optical element" of the invention.

Figure 9A:
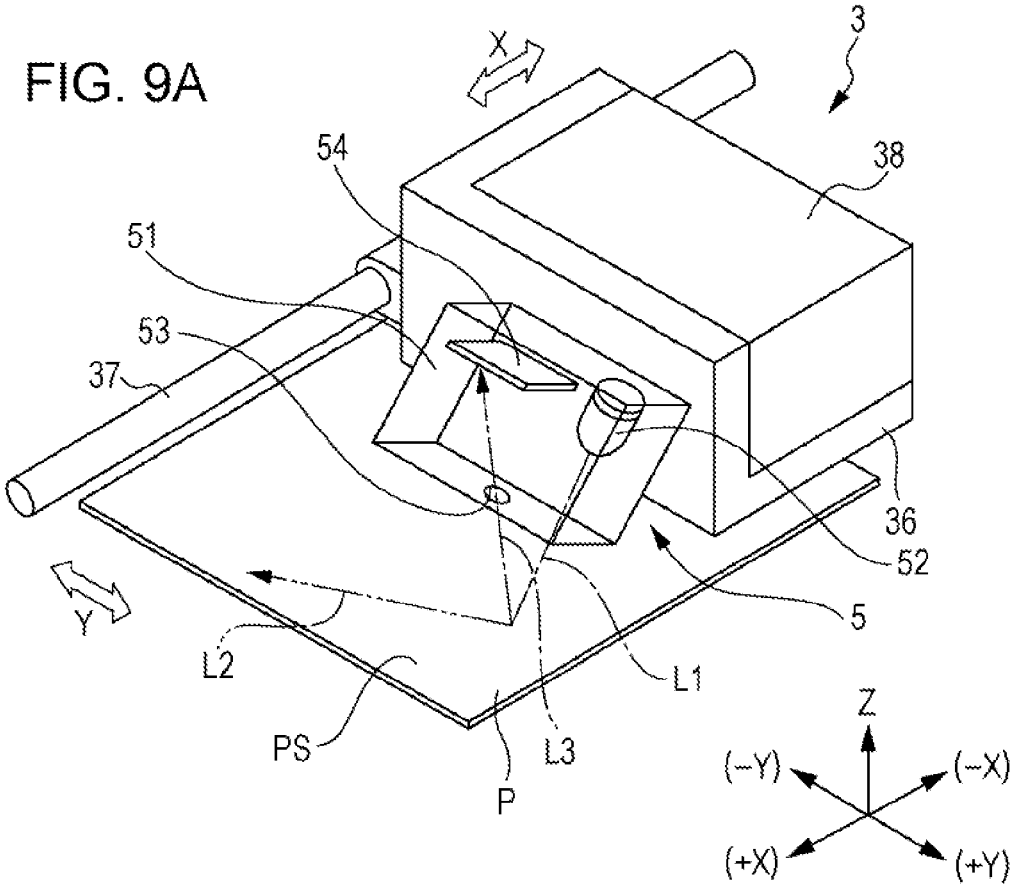
FIGS. 9A and 9B are views schematically showing a modification example of the installation state of a position detection unit to a carriage.
Figure 9B:
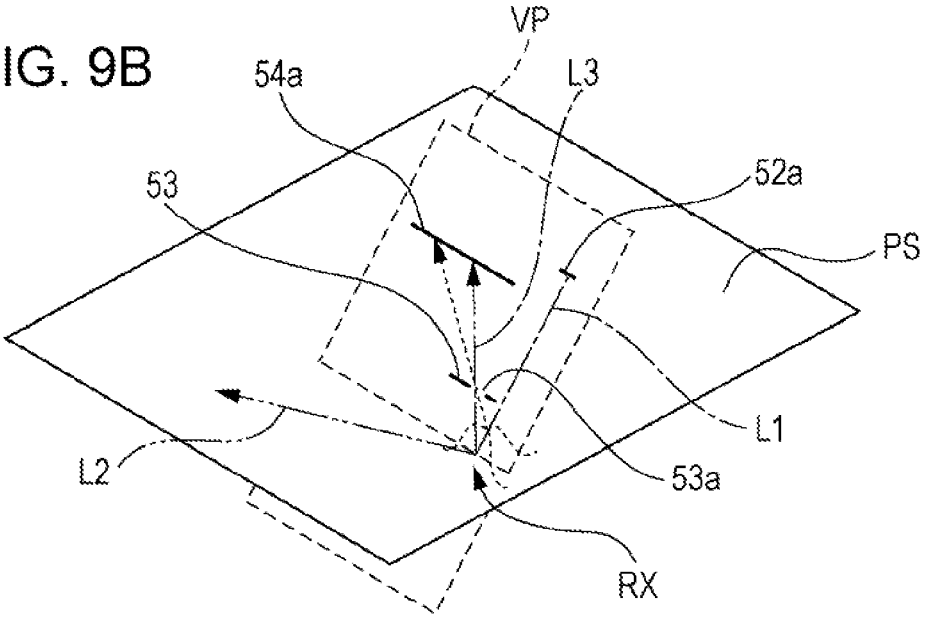
Figure 10:
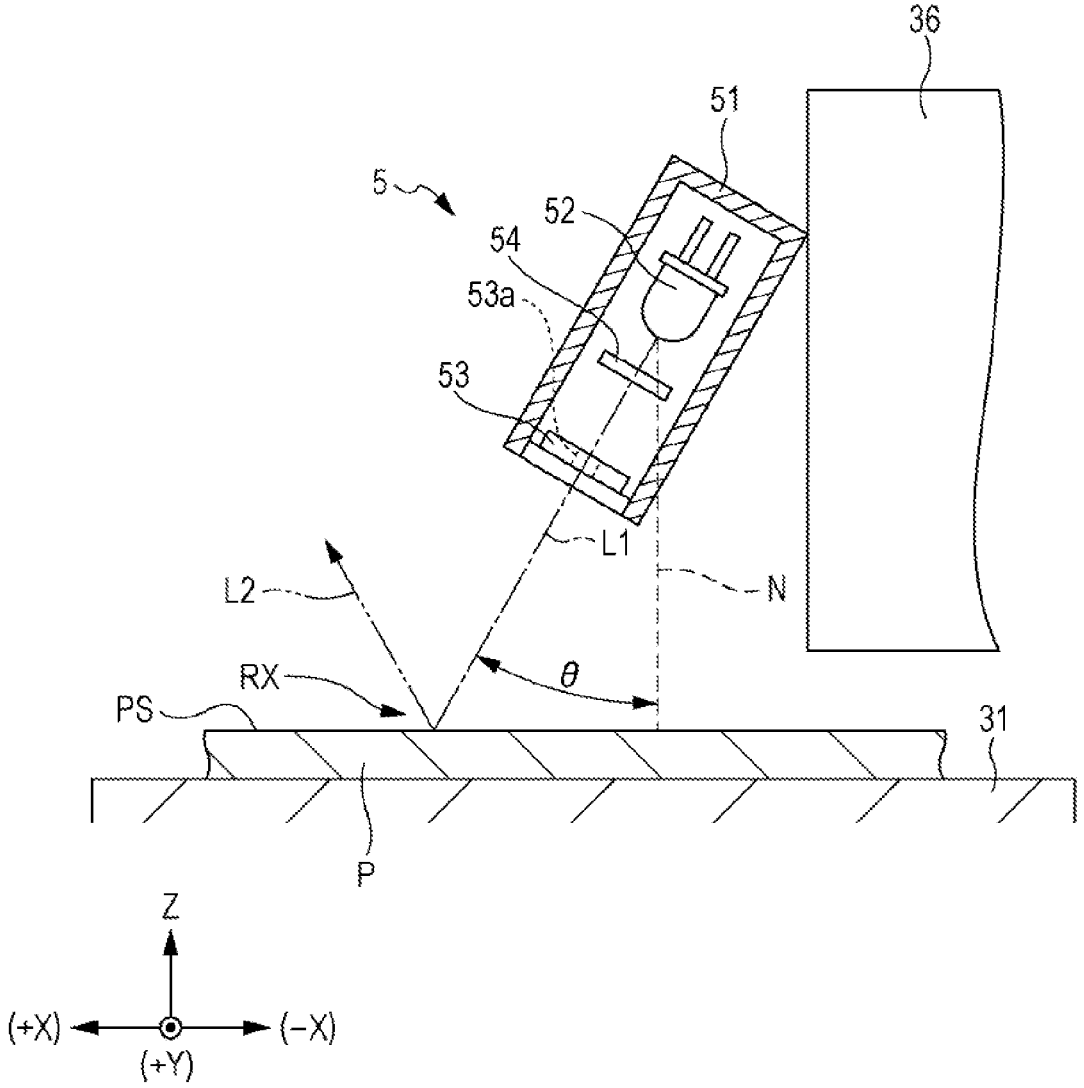
FIG. 10 is a view showing a modification example of the internal structure of the position detection unit.

FIGS. 9A, 9B and 10 are views showing modification examples of the first embodiment of the printing apparatus according to the invention.

FIGS. 9A and 9B are views showing a modification example of the configuration of the position detection unit and the installation state thereof to the carriage. FIG. 9A is a perspective view showing the installation structure, and FIG. 9B is a view showing the disposition relationships of the various parts which configure the position detection unit. In addition, FIG. 10 is a view showing a modification example of the internal structure of the position detection unit. In the modification example, the orientation of the position detection unit is different in relation to the first embodiment described above. However, the other aspects of the configuration are common to both the modification example and the first embodiment. More specifically, the lower end portion of the housing 51 is inclined to the (+X) direction by a predetermined inclination angle θ in relation to the normal line N of the printing surface PS so as to be positioned closer to the (+X) direction side than the upper end portion. In addition, the housing 51 is installed on the (+X) side surface of the carriage 36 using a housing fixing portion (not shown) in a state in which the transparent member faces, of the printing surface PS, a measured region RX which is positioned closer to the (+X) direction side than the carriage 36.

In addition, as shown in FIG. 9A, the light source 52 and the light receiving element 54 are disposed to be separated from each other in the sub-scanning direction Y in the internal vacancy of the housing 51. Of these, the light source 52 is fixed in a state in which a light emitting surface 52*a* faces the measured region RX at the (+Y) direction side in relation to the light receiving element 54. Therefore, the light beam L1 generated by the light source 52 is emitted to be inclined to the (+X) direction in relation to the normal line N of the printing surface PS by the angle θ in the same manner as the housing 51, and the measured region RX is irradiated with the light beam L1 via the transparent member. Furthermore, the light beam L1 reflects at the measured region RX and, as shown by the two-dot chain lines in FIGS. 9A and 9B, regular reflection light L2 of the reflection light proceeds in a separating direction from the carriage 36 and the housing 51, that is, the (+X) direction.

Furthermore, in the light receiving element 54 of the modification example, corresponding to the fact that the light axis of the light beam L1 is inclined by the angle θ to the (+X) direction in relation to the normal line N, the long edge of the light receiving surface 54*a* is inclined to the (+X) direction in relation to the normal line N of the printing surface PS by the angle θ in the same manner as the housing 51, and the light receiving surface 54*a* is inclined so as to be substantially perpendicular to the light axis of the light beam L1. As shown by the dotted line in FIG. 9B, when the measured region RX lifts up, the angle of the diffused reflection light L3 which passes through the opening portion 53*a* of the aperture 53 and is incident to the light receiving element 54 differs from the angle before the lifting up. As a result, the position at which the diffused reflection light L3 is received by the light receiving surface 54*a* also changes. Specifically, when the lifting up does not occur, that is, when the measured region RX is positioned at a height position which is sufficiently separated from the print head 32, the light receiving element 54 receives the diffused reflection light L3 at the side (the +Y direction side) which is close to the light source of the light receiving surface 54*a*. In contrast, when the lifting up occurs, the measured region RX approaches the print head 32 and the light receiving element 54 receives the diffused reflection light L3 at the side (the −Y direction side) which is far from the light source of the light receiving surface 54*a*.

As described above, according to the modification example, the light source 52, the aperture 53 and the light receiving element 54 are disposed so that the virtual plane VP which contains the light source 52, the aperture 53 and the light receiving element 54 is inclined to the (+X) direction in relation to the normal line N of the printing surface PS. In addition, the position detection unit 5 is installed in the carriage 36 such that the light beam L1 from the light source 52 is incident at the measured region RX which is separated from the print head 32 in the main scanning direction (+X). By adopting such a configuration, it is possible to detect whether or not the lifting up occurs at the measured region RX in the previous stage of the printing. As a result, the allowable time necessary to stop the carriage movement (the stopping margin) is expanded and the rubbing and the collision of the print head 32 in relation to the printing surface PS can be effectively suppressed.

In addition, in the modification example, the position detection unit 5 is installed on the (+X) direction side of the carriage 36. However, the position detection unit, which is configured such that the virtual plane VP is inclined to the (−X) direction in relation to the normal line N, may also be installed on the (−X) direction side of the carriage 36.

Figure 6:
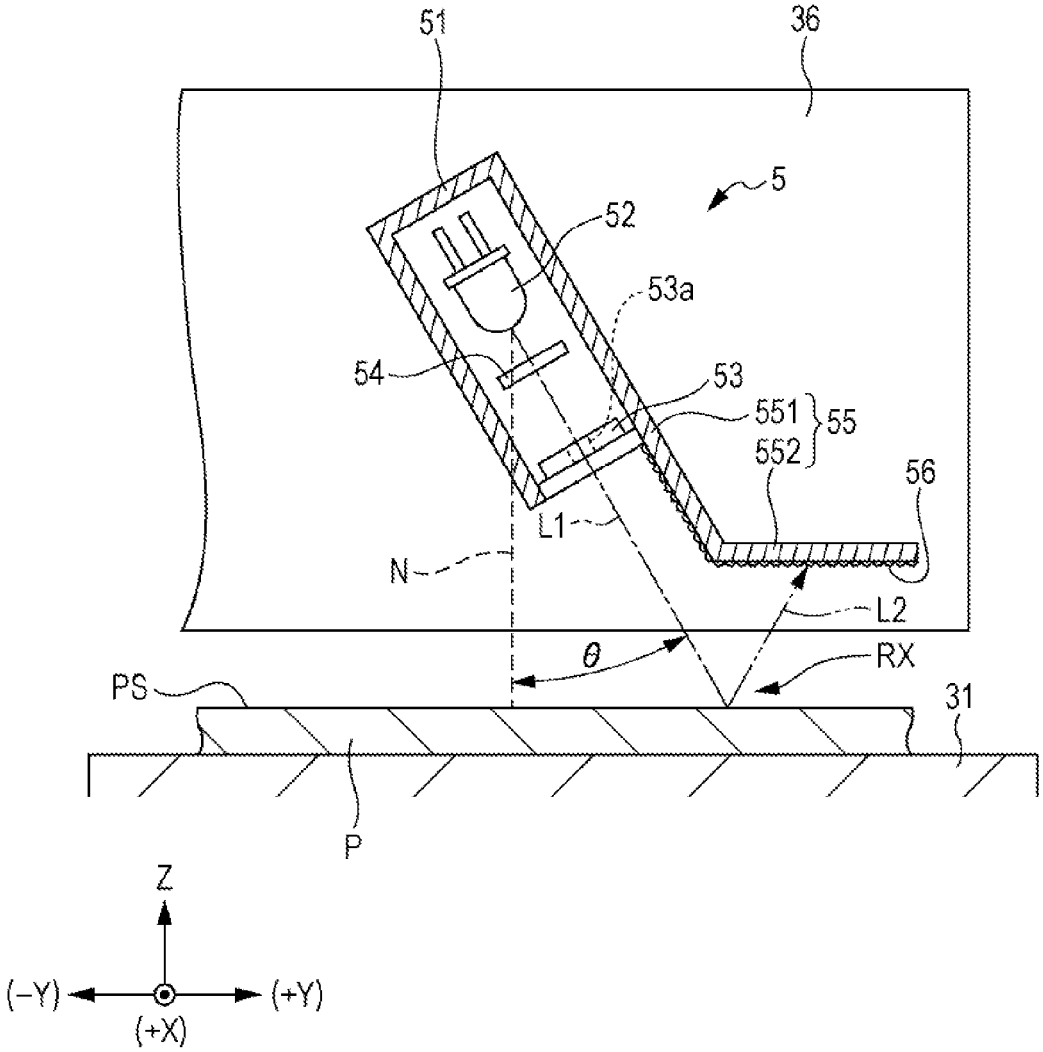
FIG. 6 is a view showing the structure of the position detection unit adopted in a second embodiment of a printing apparatus according to the invention.

FIG. 6 is a cross sectional diagram showing the second embodiment of the printing apparatus according to the invention and showing the structure of the position detection unit adopted in the second embodiment. The second embodiment greatly differs from the first embodiment in that a shielding member 55 and a reflection prevention member 56 are added, and the other configurations are essentially the same as those of the first embodiment. Accordingly, hereinafter, description will be given centered on the differences, and the same components are given the same reference numerals and description thereof will be omitted.

The shielding member 55 is provided to extend from the lower end portion of the (+Y) side of the housing 51 in the (+Y) direction and partially covers the printing surface PS from above. More specifically, as shown in FIG. 6, the shielding member 55 includes an inclined part 551 and a horizontal part 552. The inclined part 551 is provided to extend inclined by the angle θ parallel to the light beam L1 in the same manner as the housing 51, and the upper end portion of the inclined part 551 is fixed to the lower end portion of the (+Y) side of the housing 51. In addition, the lower end portion of the inclined part 551 extends to a position directly above the measured region RX. The end portion of the (−Y) side of the horizontal part 552 is connected to the lower end portion of the inclined part 551. Furthermore, the horizontal part 552 is provided to extend in the (+Y) direction and covers, from above, the measured region RX and the printing surface PS which is positioned closer to the (+Y) side than the measured region RX. Therefore, the light L2 which reflects regularly at the measured region RX is blocked by the horizontal part 552. As a result, the regular reflection light can be prevented from returning to the housing 51 side and the occurrence of stray light can be suppressed.

In addition, the reflection prevention member 56 such as matting or electrostatic flocking is provided on the incidence surface of the shielding member 55 to which the regular reflection light L2 is incident, that is, the lower surface of the horizontal part 552. Therefore, the regular reflection light L2 is prevented from reflecting at the lower surface of the horizontal part 552 by the reflection prevention member 56 and the occurrence of stray light can be further suppressed. Furthermore, in the embodiment, the reflection prevention member 56 is provided not only in relation to the horizontal part 552, but also in relation to the surface which faces the printing surface PS within the inclined part 551. Therefore, the reflection prevention member 56 reliably prevents the occurrence of stray light due to light reflection at the inclined part 551. Furthermore, even the influence of the light from outside can be suppressed by the shielding member 55 and the reflection prevention member 56.

As described above, according to the second embodiment, it is possible to suppress the occurrence of stray light and the influence of external light by adding the shielding member 55, and to increase the detection precision of the printing medium distance. In addition, since the reflection prevention member 56 is provided in addition to the shielding member 55, the occurrence of stray light and the influence of external light can be more effectively suppressed and the printing medium distance can be more accurately detected. Therefore, the rubbing and the collision of the print head 32 to the printing surface PS of the printing medium P can be suppressed with a higher precision.

Figure 7:
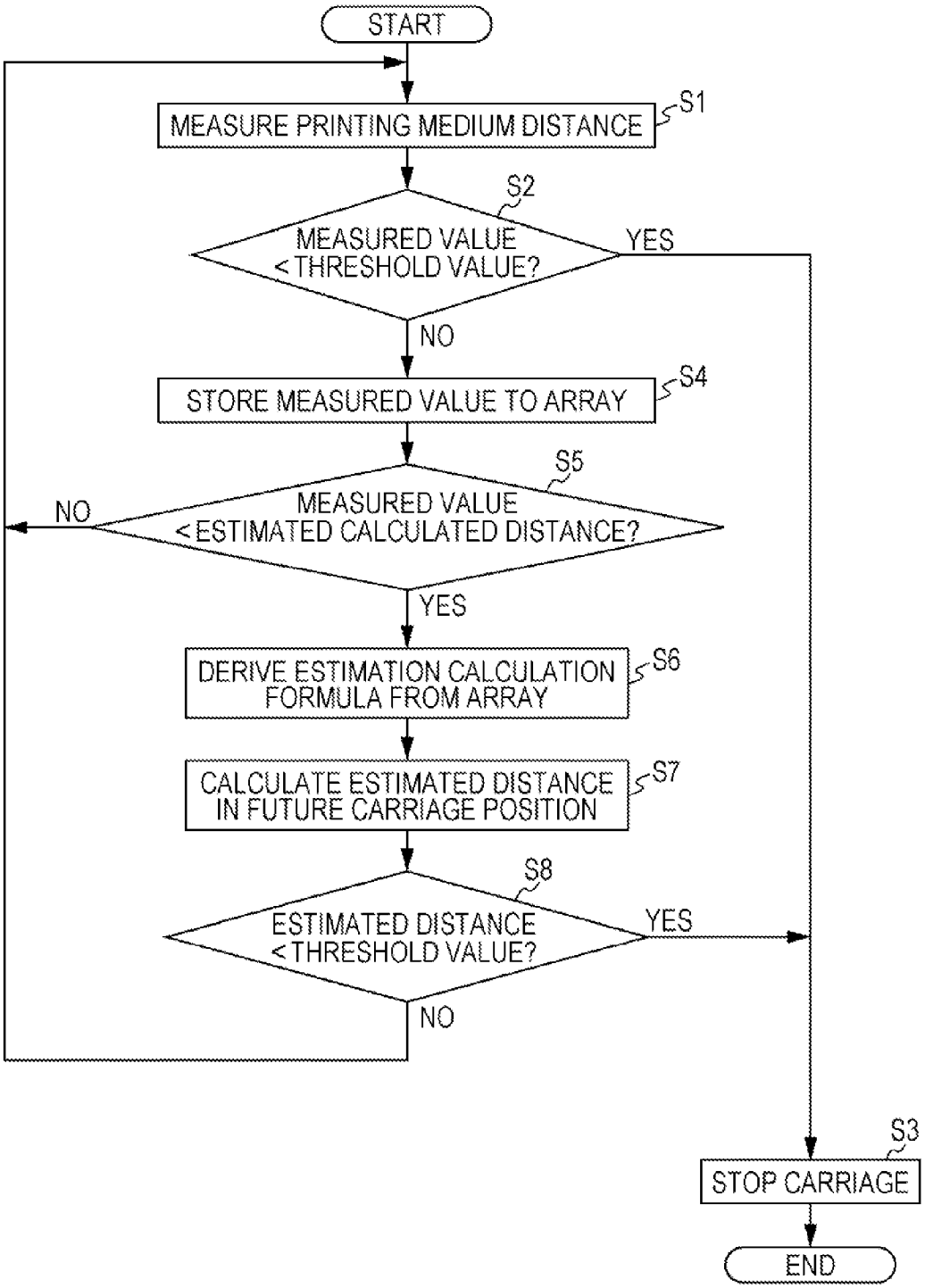
FIG. 7 is a flow chart showing the operations of a third embodiment of a printing apparatus according to the invention.
Figure 8:
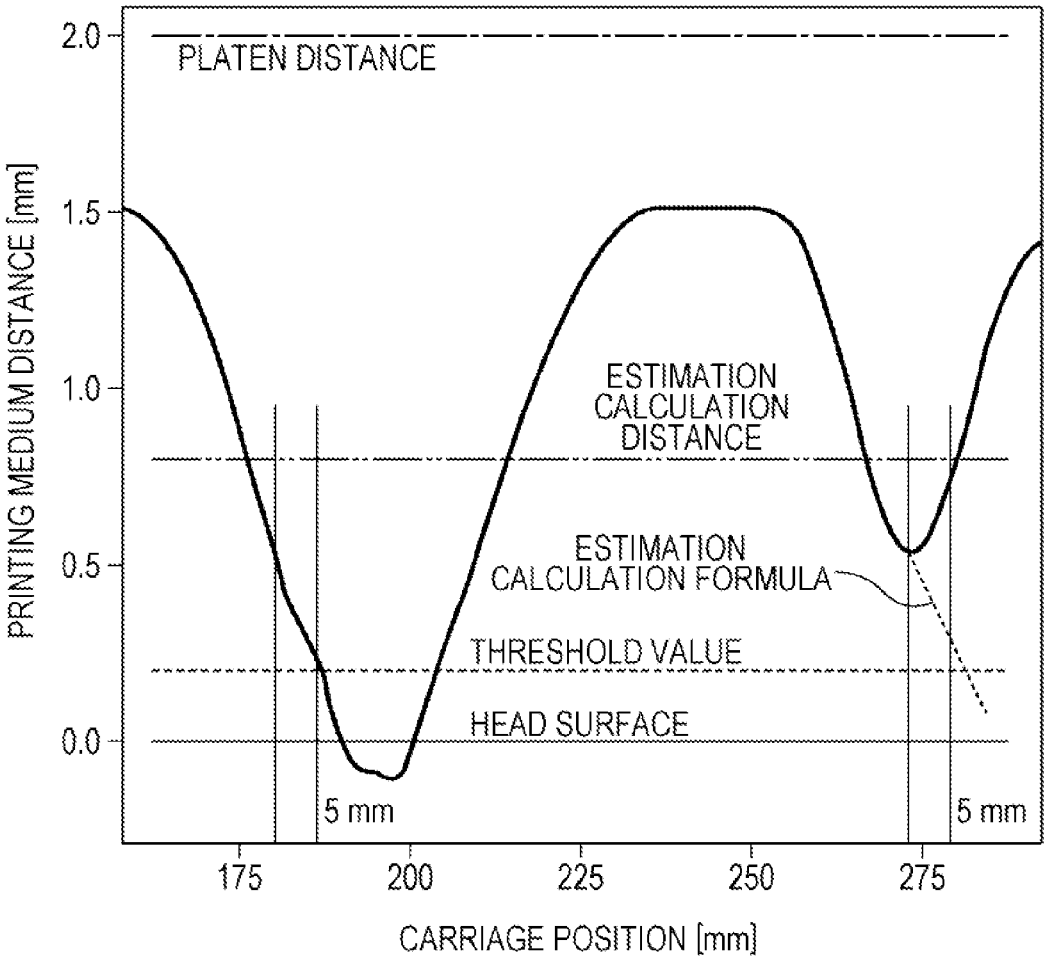
FIG. 8 is a graph showing the operation of the third embodiment of the printing apparatus according to the invention.

FIG. 7 is a flow chart showing the operations of the third embodiment of the printing apparatus according to the invention and FIG. 8 is a graph showing the operation of the third embodiment of the printing apparatus according to the invention. The third embodiment greatly differs from the first embodiment in that the estimation operation of the printing medium distance is added. In other words, in the first embodiment, the CPU 41 detects the lifting up of the printing medium P by determining whether or not the measured value is below the threshold value each time the printing medium distance is measured. Therefore, as long as the measured value of the printing medium distance is the threshold value or more, that is, as long as step S2 is determined to be "NO", the CPU 41 merely performs repeated measurements of the printing medium distance in synchronization with the movement of the carriage 36. In contrast, in the third embodiment, before actually detecting the lifting up of the printing medium P in step S2, the CPU 41 estimates the lifting up of the printing medium P on the basis of the measurement value and the previously measured measurement value and performs the movement stopping of the carriage 36 for every measurement of the printing medium distance. Furthermore, in the third embodiment, the RAM 43 includes an array (memory space) which stores N (N≥2) measured values, performs re-writing of the measured values using the first-in-first-out (FIFO) method, and the CPU 41 controls each of the apparatuses as shown below on the basis of the measured values which are stored in the array. Hereinafter, detailed description will be given of the estimation operation with reference to FIGS. 7 and 8.

During the printing operation, the measurement process of the printing medium distance described above is repeatedly executed (step S1). Furthermore, every time the printing medium distance is measured, the CPU 41 determines whether or not the measured value is less than the threshold value (step S2), and when step 2 is determined to be "YES", in the same manner as in the first embodiment, the movement of the carriage 36 is forcibly caused to stop (step S3).

Meanwhile, when step S2 is determined to be "NO", the CPU 41 newly adds the measured value of the printing medium distance to the array of the RAM 43 (step S4). Furthermore, the oldest measured value of the measured values stored in the array is deleted from the RAM 43 corresponding to the addition of a measured value. In this manner, after executing the measurement of the printing medium distance N times, the newest N measured values are stored in the array of the RAM 43.

In the next step S5, the CPU 41 determines whether or not the newest measured value is less than the estimated calculated distance. The "estimated calculated distance" is used as the standard for starting the execution of the estimation operation of the printing medium distance, and unnecessary estimation calculations (steps S6 and S7) are omitted by setting the estimated calculated distance. In other words, as long as the printing medium distance is sufficiently great, the lifting up does not occur or the lifting up amount is negligible ("NO" in step S5), the process returns to step S1 and measurement of the printing medium distance is performed without performing the estimation calculation processing (steps S6 and S7) described next. Furthermore, in the embodiment, as shown in FIG. 8, the estimated calculated distance is set to a value of approximately 40% of the interval between the platen 31 and the print head 32. However, when the value is greater than the threshold value, the set value of the estimated calculated distance is arbitrary. However, from a perspective of omitting unnecessary estimation calculation (steps S6 and S7), it is favorable to set the upper limit to less than 50%.

Meanwhile, when step S5 is determined to be "YES", the CPU 41 reads out N measured values from the array of the RAM 43 and derives the change in the printing medium distance which accompanies the movement of the carriage on the basis of the N measured values as an estimation calculation formula (step S6). In the embodiment, as shown by the dotted line in FIG. 8, a linear function which is obtained using the least squares method is used as the estimation calculation formula. Naturally, the estimation calculation formula is not limited thereto, and a calculation formula which is suitable for extrapolation may be obtained.

In the next step S7, the CPU 41 calculates the printing medium distance at a position in front of the carriage position at the time of measurement, for example, a position 5 mm in front of the carriage position (hereinafter referred to as the "estimated distance") on the basis of the estimation calculation formula. Furthermore, as long as the estimated distance is the threshold value or more ("NO" in step S8), the CPU 41 returns to step S1 and continually performs measurement of the printing medium distance while causing the carriage 36 to move in the main scanning direction X. Meanwhile, when the estimated distance is less than the threshold value ("YES" in step S8), the CPU 41 forcibly stops the movement of the carriage 36 (step S3).

As described above, in the third embodiment, since lifting up of the printing medium P is detected in the same manner as in the first embodiment, the same effects can be gained as in the first embodiment. In addition, in the third embodiment, the lifting up is detected by estimating the change in the printing medium distance, and the lifting up of the printing medium P can be detected earlier in comparison with the first embodiment. Therefore, the third embodiment can further reinforce the effects of the first embodiment. In other words, according to the third embodiment, the carriage 36 can be forcibly stopped with a leeway by performing estimation detection, and the effect of suppressing the rubbing or the collision of the print head 32 with the printing surface PS can be further increased.

Furthermore, the invention is not limited to the embodiments described above, and various modifications other than those described above can be made without departing from the spirit of the invention. For example, in the configuration according to the embodiments, the diffused reflection light L3 is incident to the light receiving surface 54*a* of the light receiving element 54 through the aperture 53. However, a lens may also be used instead of the aperture 53, and in this case, the lens functions as the "optical element" of the invention.

In addition, in the embodiments, the virtual plane VP is configured so as to be inclined to the (+Y) direction in relation to the normal line N. However, the inclination direction of the virtual plane VP is not limited thereto, for example, a configuration may also be adopted in which the virtual plane VP is inclined to the (−Y) direction in relation to the normal line N. In addition, the position detection unit 5 is installed on the (+X) direction side of the carriage 36. However, instead of the position detection unit 5, the position detection unit may also be installed on the (−X) direction side of the carriage 36. In addition, the position detection unit 5 may be installed on the (+X) direction side and the (−X) direction side, and in this case, a configuration may be adopted in which the lifting up of the printing medium P is detected by the position detection unit 5 of the (+X) direction side while the carriage 36 moves in the (+X) direction, and the lifting up of the printing medium P is detected by the position detection unit 5 of the (−X) direction side while the carriage 36 moves in the (−X) direction.

In addition, without being limited to the embodiments, an image can be formed on the printing surface PS of the printing medium P by causing the carriage 36 to move in the main scanning direction X and the sub-scanning direction Y, and an image can also be formed on the printing surface PS of the printing medium P by causing the printing medium P to be transported in the main scanning direction X and the sub-scanning direction Y. In any of the modes described above, it is preferable that the position detection unit 5 be installed in the carriage 36 on at least one of the relative movement directions of the carriage 36 and the printing medium P, and the position detection unit 5 may also be installed on at least one of the (+Y) direction side and the (−Y) direction side of the carriage 36.

In addition, in the embodiments, the light receiving element 54 is disposed such that the light receiving surface 54*a* is substantially perpendicular to the light axis of the light beam L1. However, the disposition mode of the light receiving element 54 is not limited thereto, for example, the light receiving element 54 may also be disposed such that the light receiving surface 54*a* is substantially parallel to the light axis of the light beam L1. In this case, when the lifting up does not occur, that is, when the measured region RX is positioned at a height position which is sufficiently separated from the print head 32, the light receiving element 54 receives the diffused reflection light L3 at the side separated from the printing surface PS of the light receiving surface 54*a*. In contrast, when the lifting up occurs, the measured region RX approaches the print head 32 and the light receiving element 54 receives the diffused reflection light L3 at the side which is close to the printing surface PS of the light receiving surface 54*a*.

The entire disclosure of Japanese Patent Application No. 2012-262117, filed Nov. 30, 2012 and 2012-276559, filed Dec. 19, 2012 are expressly incorporated by reference herein.

What is claimed is:

1. A printing apparatus that forms an image on a printing surface of a printing medium, which is transported in a sub-scanning direction, by causing a carriage with a printing unit mounted thereon to move in a main scanning direction, comprising:

a position detection unit, which includes an optical element configured by an aperture or a lens, a light source and a light receiving element, irradiates the printing surface with light from the light source, causes diffused reflection light which is reflected by the printing surface to be incident to the light receiving element through the optical element and outputs positional information relating to a position of the printing surface at which the light from the light source reflects, from the light receiving element, and a controller which causes movement of the carriage to stop when lifting up of the printing medium is detected on a basis of the positional information output from the light receiving element, wherein the light source is inclined in a direction different from a direction toward the light receiving element, wherein a virtual plane which contains the light source, the optical element and the light receiving element is in a state of being inclined at an angle of 15° or more and 45° or less in relation to a normal line of the printing surface.

2. The printing apparatus according to claim 1, wherein the virtual plane is in a state of being inclined in the sub-scanning direction in relation to the normal line of the printing surface.

3. The printing apparatus according to claim 1, wherein the virtual plane is in a state of being inclined in the main scanning direction in relation to the normal line of the printing surface.

4. The printing apparatus according to claim 3, wherein the position detection unit is installed on the carriage such that the light from the light source reflects at a position which is distanced from the printing unit in the main scanning direction.

5. The printing apparatus according to claim 1, wherein the position detection unit includes a housing which accommodates the optical element, the light source and the light receiving element, and a shielding member configured by a material which is non-transmissive in relation to regular reflection light of reflection light which is reflected by the printing surface, and wherein the shielding member is provided to extend from the housing in a direction in which the regular reflection light proceeds, and blocks the regular reflection light.

6. The printing apparatus according to claim 5, wherein the position detection unit includes a reflection prevention member, which is provided on an incidence surface of the shielding member to which the regular reflection light is incident, and which prevents reflection of the regular reflection light at the incidence surface.

7. The printing apparatus according to claim 1, wherein the controller is provided with a distance derivation unit which obtains a printing medium distance from the printing unit to the printing surface on a basis of positional information which is output from the light receiving element;

a lifting up detection unit which detects lifting up of the printing medium on the basis of the printing medium distance obtained by the distance derivation unit, and a movement stopping unit which causes movement of the carriage to stop when the lifting up detection unit detects the lifting up of the printing medium.

8. The printing apparatus according to claim 7, wherein the lifting up detection unit detects the lifting up of the printing medium on the basis of whether or not the printing medium distance is shorter than a threshold value which is set in advance.

9. The printing apparatus according to claim 7, wherein the lifting up detection unit obtains the printing medium distance as an estimated distance when the carriage is assumed to have moved only a distance which is set in advance, and detects the lifting up of the printing medium on the basis of whether or not the estimated distance is shorter than a threshold value which is set in advance.

10. The printing apparatus according to claim 9, wherein the lifting up detection unit obtains a change in the printing medium distance which accompanies movement of the carriage, and obtains the estimated distance on the basis of the change.

* * * * *